US006729414B2

(12) United States Patent
Cooper et al.

(10) Patent No.: US 6,729,414 B2
(45) Date of Patent: May 4, 2004

(54) CORDLESS DRILL WITH METAL HOUSING

(75) Inventors: Vincent P. Cooper, Baltimore, MD (US); Edd Huxley, Tai Po (HK); Gavin Ng, Tai Po (HK); Raymond Chan, Tai Po (HK)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/196,835

(22) Filed: Jul. 16, 2002

(65) Prior Publication Data

US 2004/0011544 A1 Jan. 22, 2004

(51) Int. Cl.[7] ..... E21B 4/12
(52) U.S. Cl. ..... 173/217; 173/216; 310/50
(58) Field of Search ..... 173/117, 93.6, 173/104, 216, 217; 310/47, 50; 475/298, 299

(56) References Cited

U.S. PATENT DOCUMENTS 2,965,774 A * 12/1960 Rangus ..... 310/50
5,339,908 A 8/1994 Yokota et al. ..... 173/216
5,360,073 A * 11/1994 Akazawa ..... 173/15
5,375,665 A * 12/1994 Fanchang et al. ..... 173/48
5,494,115 A * 2/1996 Hwong ..... 173/13
5,624,000 A * 4/1997 Miller ..... 173/216
5,706,902 A * 1/1998 Eisenhardt ..... 173/93.5
5,897,454 A * 4/1999 Cannaliato ..... 475/265
6,102,632 A * 8/2000 Potter et al. ..... 408/124

* cited by examiner

*Primary Examiner*—Scott A. Smith
*Assistant Examiner*—Nathaniel Chukwurah
(74) *Attorney, Agent, or Firm*—Harness, Dickey & Pierce, P.L.C.

(57) ABSTRACT

A power tool with a metal housing (12) has motor (20) positioned within the housing (12). An output (22), positioned within the housing (12), is coupled with the motor (20) and is adapted to drive a tool. An activation member (26) is coupled with the motor (20). A battery pack (30) is electrically coupled with the activation member (26). The activation member (26) energizes and deenergizes the motor (20), which in turn, drives the output (22).

33 Claims, 4 Drawing Sheets

CORDLESS DRILL WITH METAL HOUSING

FIELD AND BACKGROUND OF THE INVENTION

The present invention relates to power tools and, more particularly, to battery operated power tools with metallic housings.

In the power tool field, as battery technology continues to improve, tradesmen continue to switch to battery operated tools. Battery operated tools have housings that are of a polymeric material. The polymeric material provides lightweight characteristics with acceptable durability. Corded tools have long since utilized metallic housing. While the metallic housings do not adversely deter from the tools weight, they provide enhanced durability characteristics.

SUMMARY OF THE INVENTION

The present invention provides the art with a battery operated power tool with a metallic housing. The present invention provides the art with a lightweight battery operated tool with excellent durability. The power tool provides the corded user with a non-corded metallic housing tool.

In accordance with the first aspect of the invention, a power tool comprises a metallic housing. A motor is positioned inside the metallic housing. An output is coupled with the motor. The output is adapted to drive a tool. An activation member is coupled with the motor. A battery power source is electrically coupled with the activation member. The activation member energizes and deenergizes the motor which, in turn, rotates the output member. The activation member includes a switch which is electrically coupled with the battery power source and the motor. A polymeric subhousing surrounds the switch and is positioned in the metallic housing. The polymeric subhousing shields the activation member and motor from the metal housing. The polymeric subhousing includes a first subhousing shielding the activation member and a second subhousing shielding the motor. A barrier plate is positioned in the housing between the battery and an inner cavity of the metal housing. The barrier plate is a polymeric material. The output includes a transmission for changing speeds and torque of the output. The transmission includes a polymeric housing, first pinion or sun gear, first set of planetary gears, a first gear carrier and an insulating member. The insulating member is positioned between the first gear carrier and the first pinion gear to provide insulation against a possible failure route. The battery source has a polymeric housing coupled with the metal housing.

In accordance with a second embodiment of the invention, a battery operated power tool comprises a housing defining a cavity. The housing includes a pair of mating members each formed from a metallic material. A motor is received in the housing cavity. An activation member extends from the housing and is coupled with the motor. An output member is coupled with the motor and is adapted to drive a tool. A battery pack is coupled with the housing. The battery pack is electrically coupled with the activation member to energize and deenergize the tool. The power tool further includes a battery level indicator electrically coupled with the battery pack mounted on the housing. The power tool further includes a level indicator coupled with the housing which determines the levelness of the power tool in vertical and horizontal positions. The power tool further includes a gripping member. The power tool housing pair defines a handle portion. The activation member is housed in the handle portion and includes a switch electrically coupled with the battery. A polymeric housing surrounds the switch and is positioned in the handle portion of the metal housing. A barrier plate is positioned between the battery and the cavity of the metal housing. The output includes a transmission to change speed and torque of the output. The transmission includes a polymeric housing, first pinion or sun gear, first set of planetary gears, a first gear carrier and an insulating member. The insulating member is positioned between the first gear carrier and the first pinion gear to provide insulation against a possible failure route.

In accordance with the third aspect of the invention, a cordless drill comprises a metallic housing. A motor is positioned inside the metallic housing. An output is coupled with the motor. The output is adapted to drive a tool. An activation member is coupled with the motor. A battery power source is electrically coupled with the activation member. The activation member energizes and deenergizes the motor which, in turn, rotates the output member. The activation member includes a switch which is electrically coupled with the battery power source and the motor. A polymeric subhousing surrounds the switch and is positioned in the metallic housing. The polymeric subhousing shields the activation member and motor from the metal housing. The polymeric subhousing includes a first subhousing shielding the activation member and a second subhousing shielding the motor. A barrier plate is positioned in the housing between the battery and an inner cavity of the metal housing. The barrier plate is a polymeric material. The output includes a transmission for changing speeds and torque of the output. The transmission includes a polymeric housing, first pinion or sun gear, first set of planetary gears, a first gear carrier and an insulating member. The insulating member is positioned between the first gear carrier and the first pinion gear to provide insulation against a possible failure route. The battery source has a polymeric housing coupled with the metal housing.

Additional objects and advantages of the present invention will become apparent from the detailed description of the preferred embodiment, and the appended claims and accompanying drawings, or may be learned by practice of the invention.

DETAILED DESCRIPTION OF THE PREFERRED EMBODIMENT

Figure 1:
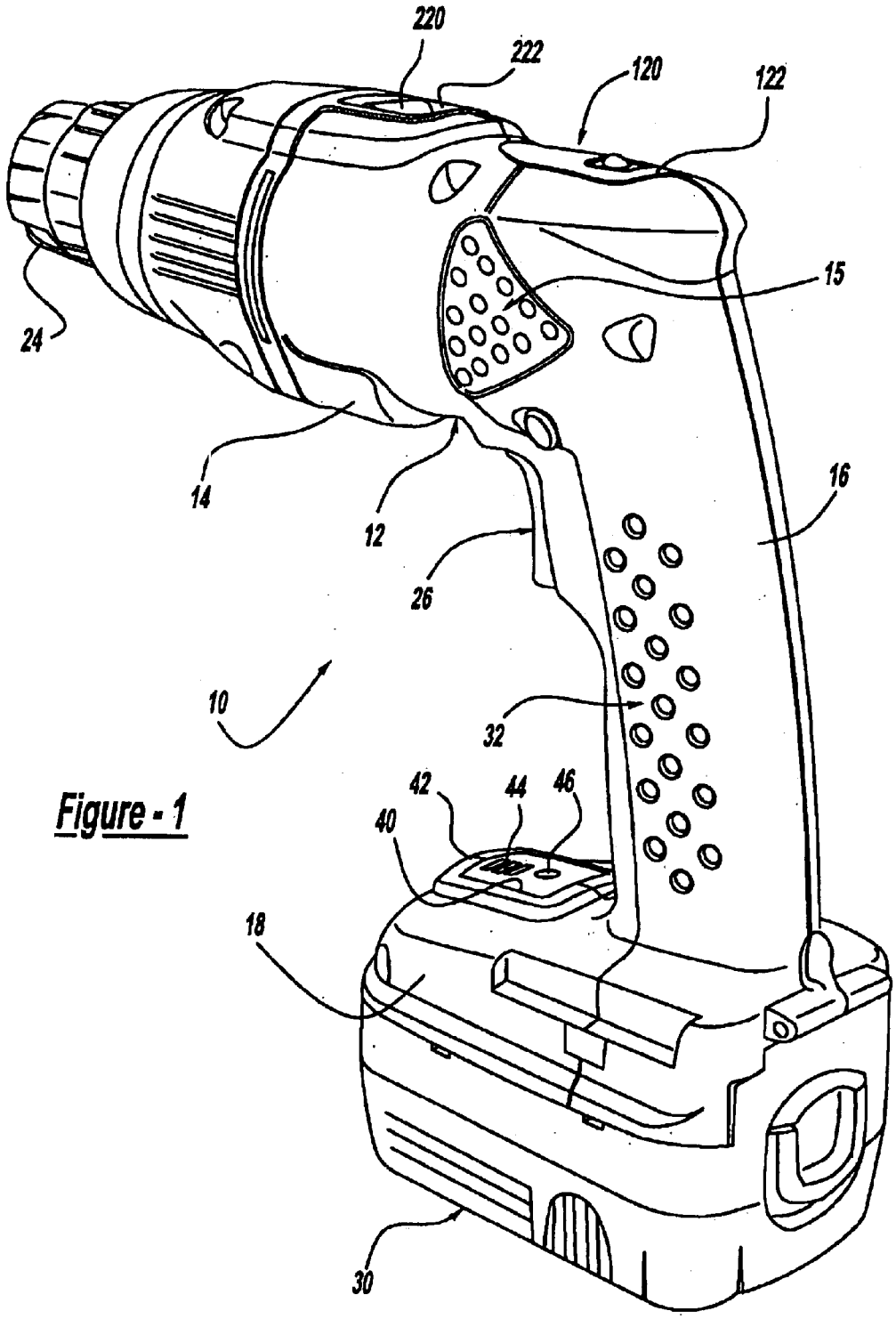
FIG. 1 is a perspective view of a power tool in accordance with the present invention.
Figure 2:
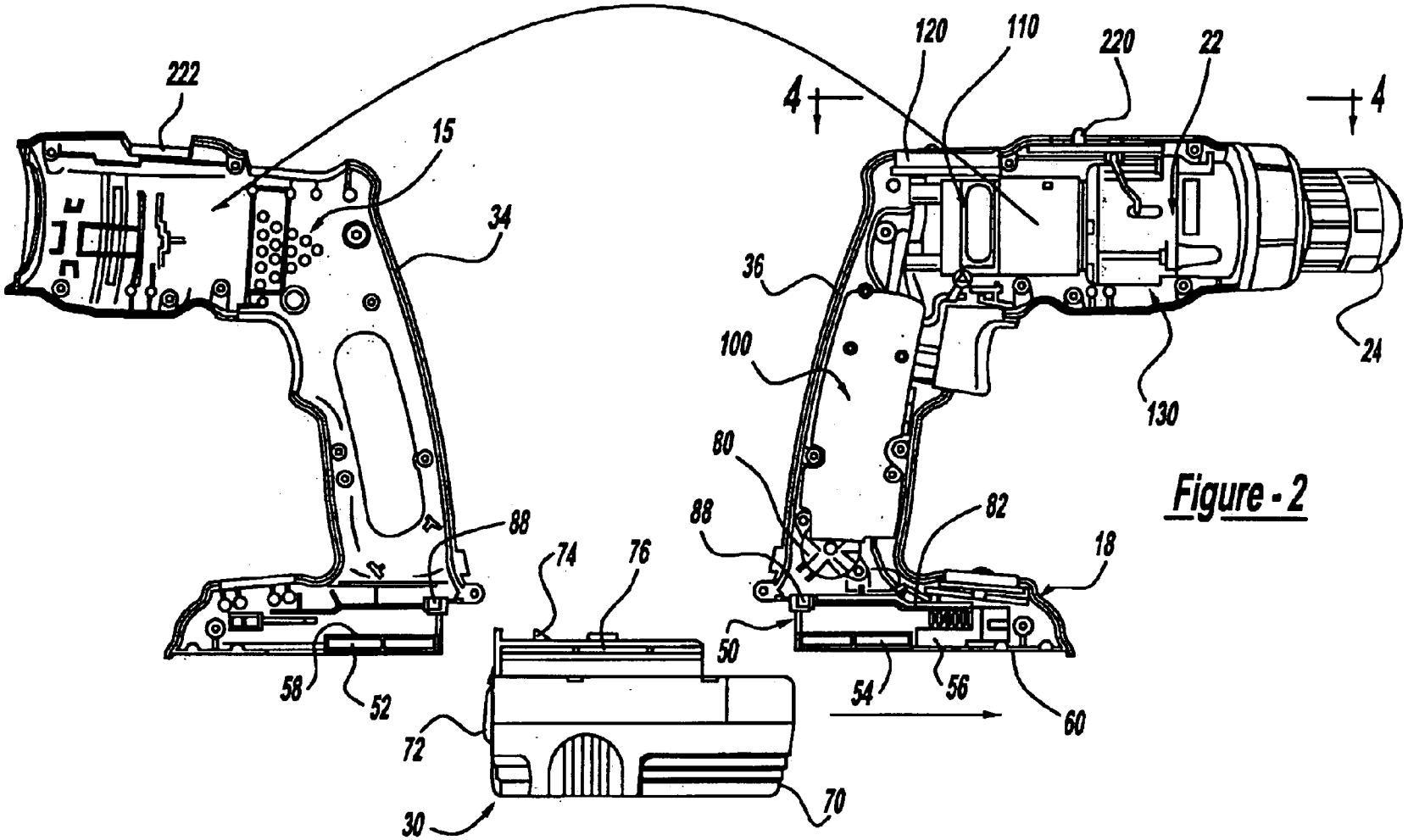
FIG. 2 is a side elevation view of FIG. 1 with one of the housing members removed.
Figure 3:
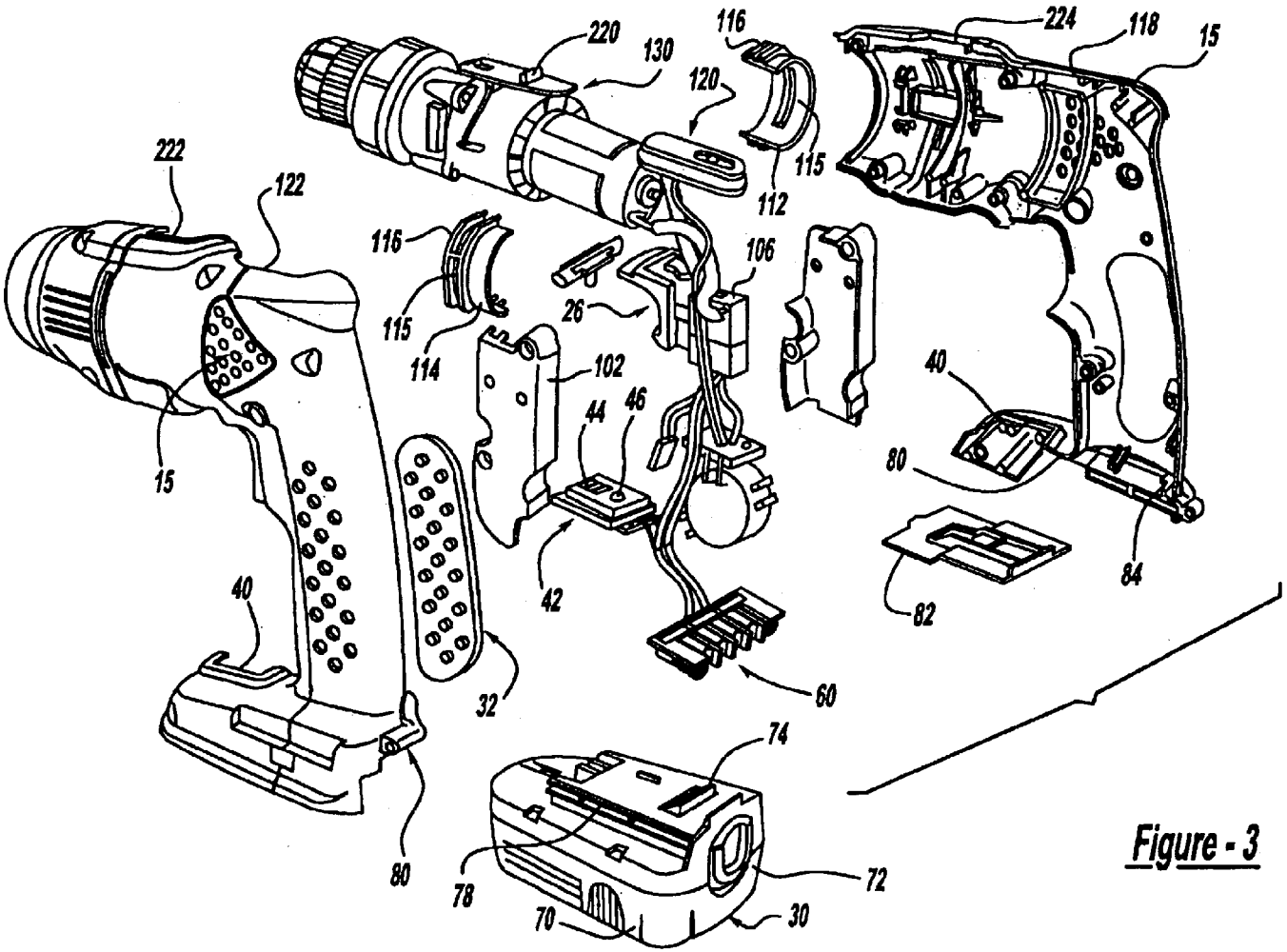
FIG. 3 is a partially exploded view of FIG. 2.
Figure 4:
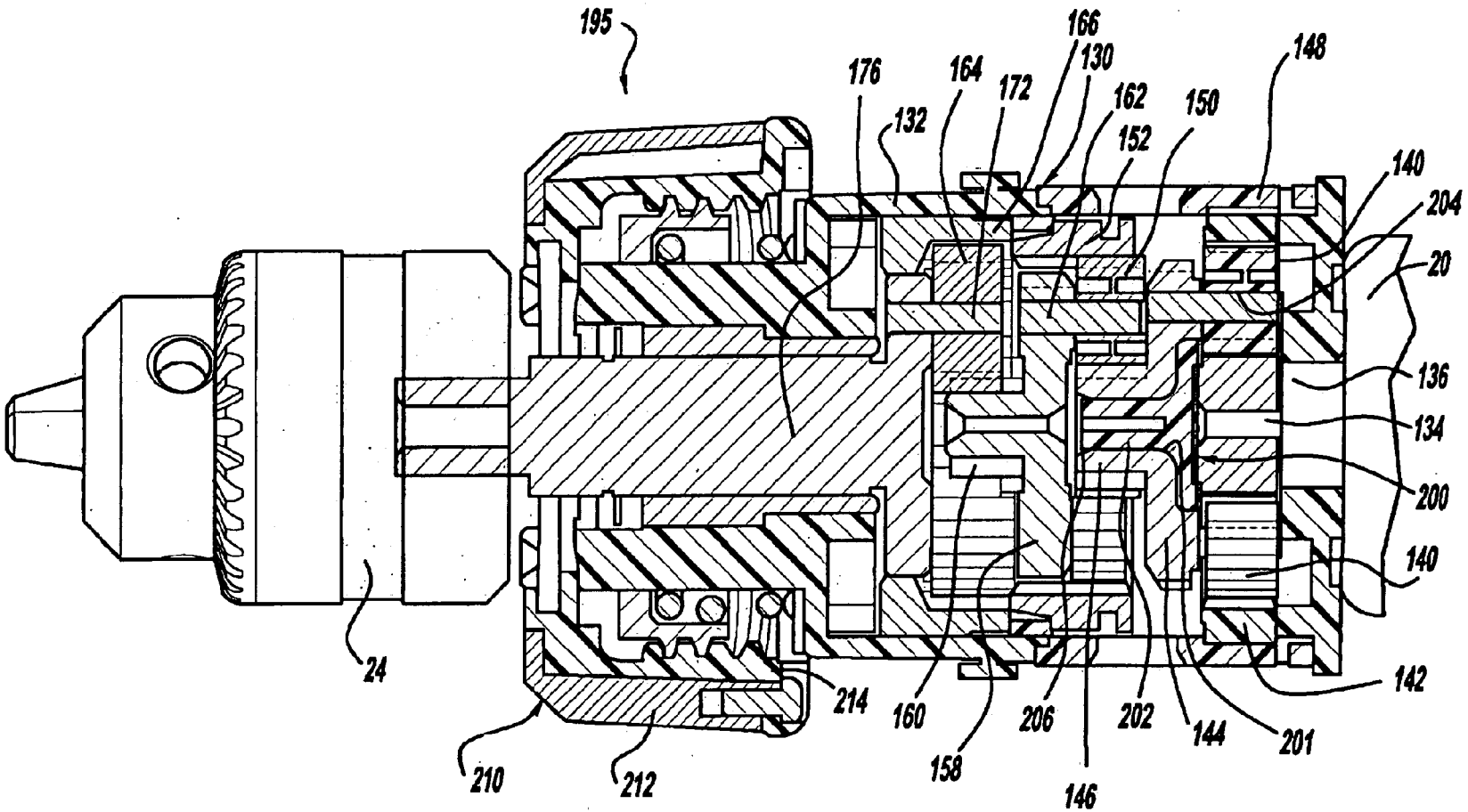
FIG. 4 is a cross-section view of FIG. 2 along line 4—4 thereof.

Turning to the figures, particularly FIG. 1, a power tool is illustrated and designated with the reference numeral 10. The power tool 10 includes a housing 12 which includes a motor portion 14 with vents 15, a handle portion 16 as well as a base portion 18. A motor 20 is positioned in the housing 12. An output 22 is coupled with the motor 20 and in this case includes a chuck 24. An activation member 26 is associated with the handle portion of the housing 12. The activation member is electrically coupled with the motor 20 as well as with the battery pack 30 which supplies the power to the power tool 10. A gripping member 32 is coupled with the handle portion of the housing 12.

The housing 12 includes a pair of mating housing members 34 and 36. The mating members 34 and 36 have a clam shell design and come together to form the housing 12. The two housing members 34 and 36 are manufactured from a metallic material. In the present case, aluminum is utilized. Aluminum provides a lightweight material at a reasonable cost.

The housing base 18 includes an aperture 40 to receive a battery level indicator 42. The battery level indicator 42 includes an illumination mechanism 44 and an activation mechanism 46 to indicate to the user the amount of power remaining in the battery pack 30. The battery level indicator 42 is electrically coupled via wires with the battery pack 30.

The base 18 includes a battery receiving receptacle 50. The battery receiving receptacle includes rails 52 and 54 and channels 56 and 58. Also an electrical connector 60 is mounted in the housing. The battery receiving receptacle is like that illustrated in assignee's co-pending U.S. patent application Ser. No. 09/938,202 entitled "Power Tool with Battery Pack Ejector" filed Aug. 24, 2001, the specification and drawings of which are herein expressly incorporated by reference.

The battery pack 30 includes a housing 70 with a plurality of batteries (not shown) positioned within the housing. A release button 72 is coupled with a latch 74 to lock the battery on the metal housing 12. Also the battery pack 30 includes rails 76 and 78 which fit into channels 56 and 58 to retain the battery pack 30 on the metal housing base 18. Further details can be obtained from U.S. patent application Ser. No. 09/938,202 entitled "Power Tool with Battery Pack Ejector" filed Aug. 24, 2001, the specifications and drawings of which are herein expressly incorporated by reference.

The housing base 18 includes an opening 80 which has an overall rectangular design. A barrier plate 82 is positioned into the housing opening 80 to block off the housing cavity from the battery pack. The barrier plate 82 is ordinarily a polymeric material and prohibits dirt, debris and the like from entering into the housing cavity. Likewise, the barrier plate insulates the electrical connector 60 from contact with the metal housing 12. The barrier plate fits into channels 84 in the housing base 18. The channels 84 maintain the barrier plate in position so that the barrier plate 82 provides the desired characteristics.

The base 18 also includes a rail 88 which acts as a catch for the battery latch 78. The rail 88 is formed from the metal housing and defines a side of the opening 80 which the barrier plate actively blocks.

A subhousing 100 is positioned within the handle portion of the housing 12. The subhousing 100 has a configuration which fits within the handle portion 16 of the metal housing 12. The subhousing 100 is of a claim shell design having two members 102 and 104. The two members 102 and 104 surround the switch 106 of the activation member 26. Thus, the subhousing members 102, 104 electrically insulate the switch 106 from the metallic housing 12. The subhousing members 102, 104 are preferably transparent. This enables the assembler to view the switch and wires to ensure proper installation. The subhousing 100 is held in position, ordinarily by screws, on the metallic housing to maintain the spacing of the switch 106 within the handle portion 16 of the housing 12.

A second subhousing member 110 is positioned around the motor 20. The second subhousing 110 includes a pair of members 112 and 114. The members 112 and 114 are arcuate and have projections 116 which extend into recesses 118 adjacent vents 15 on the inner surface of motor portion 14 of the housing 12. The subhousing members 112 and 114 surround at least a portion of the motor 20. Apertures 115 are positioned inside of the projections 116. The apertures 115 enable air flow to pass between the motor and the outside through vents 15. Thus, when the housing members 34 and 36 are assembled together, the motor 20 is spaced from the metallic housing 12. Thus, the motor 20 is insulated and shielded from the metallic housing 12.

A level indicating device 120 is positioned in an aperture 122 in the housing 12. The level indicating device 120 indicates when the tool is in a vertical or horizontal position. The level indicating device is like that disclosed in assignee's co-pending U.S. patent application Ser. No. 10/075,927 entitled "Drill Level Indicator", the specification and drawings of which are herein expressly incorporated by reference.

The output includes a transmission 130. The transmission 130 is of a conventional three-stage speed reduction type having a polymeric housing 132. A output spindle 134 extends from the motor 20 and is coupled with a first sun or pinion gear 136. The first pinion gear 136 is coupled with a first set of planetary gears 140. The planetary gears 140 rotate within a ring gear 142. A first gear carrier 144 which includes an integral second sun gear 146 is coupled with the first set of planetary gears 140 via pins 148. The second sun gear 144 is coupled with a second set of planetary gears 150. The second set of planetary gears 150 rotates within a moveable ring gear 152. The moveable ring gear 152 moves side to side to change the speed and torque of the transmission 130. A transmission activation member 220 is positioned within an aperture 222 of the housing 12. The activation member 220 slides within a channel 224 in the housing 12 to move the transmission 130 between different speeds and torque. The second set of planetary gears 150 is coupled with a second gear carrier 158. The second gear carrier 158 has a third sun gear 160 integrally formed on the second gear carrier 158. Pins 162 connect the second set of planetary gears 150 with the second gear carrier 158. A third set of planetary gears 164 is coupled with the third sun gear 160. The third set of planetary gears 164 rotates within a ring gear 166. The third set of planetary gears 164 is coupled, via pins 172, with the drill output spindle 176 which, in turn, is coupled with the chuck 24. Also, a clutch mechanism 190 is coupled with the transmission 130.

An insulating member 200 is positioned in the transmission 130. The insulation member 200 is molded into the bore 201 of the first gear carrier 144 to insulate the first pinion gear 136 from the first gear carrier 144. The insulation member 200 has a cylinder portion 202 and a flange portion 204. The flange 204 has a diameter larger than the diameter of first pinion gear 136. Thus, the insulation member 200 along with the plastic first set of planetary gears 140 and plastic ring gear 142 prohibit contact of metal parts from the pinion and in turn any possible failure route from continuing along the motor 20.

The clutch mechanism 190 includes a clutch ring 210 which is rotated by the user to activate the clutch mechanism 190. The clutch ring 210 includes a first metallic ring 212 and a second inner polymeric ring 214. The rings 212, 214 act together to enable activation of the clutch mechanism 190. The polymeric ring 214 provides an insulation barrier between the outer metallic ring 212 and the cavity of the power tool 10.

While the above detailed description describes the preferred embodiment of the present invention, the invention is susceptible to modification, variation and alteration without deviating from the scope and fair meaning of the subjoined claims.

What is claimed is:

1. A power tool comprising:

a metal housing;

a motor positioned inside said housing;

an output coupled with said motor, said output adapted to drive a tool;

an activation member coupled with said motor;

a member for electrically insulating or shielding said metal housing;

a battery powered source, said activation member electrically coupled with said battery power source for energizing and deenergizing said motor.

2. The power tool according to claim 1 wherein said activation member includes a switch electrically coupled with said battery power source and said motor.

3. The power tool according to claim 2 wherein said member for electrically insulating or shielding further comprising:

a polymeric housing surrounding said switch and positioned in said metal housing.

4. The power tool according to claim 1 said member for electrically insulating or shielding further comprising:

a polymeric subhousing in said metal housing, said polymeric subhousing shielding said activation member and motor from said metal housing.

5. The power tool according to claim 4 wherein said polymeric subhousing includes a first subhousing shielding said activation member and a second subhousing shielding said motor.

6. The power tool according to claim 1 wherein a barrier plate being positioned between said battery and an inner cavity of said metal housing.

7. The power tool according to claim 6 wherein said barrier plate being a polymeric material.

8. The power tool according to claim 1 wherein said output includes a transmission for transmitting power from the motor.

9. The power tool according to claim 8 wherein said transmission includes a polymeric housing, a first pinion gear, a first set of planetary gears, a first gear carrier and an insulating member between said first gear carrier and said first pinion gear for providing insulation against a possible failure route.

10. The power tool according to claim 1 wherein said battery power source includes a polymeric housing coupled with said metal housing.

11. The power tool according to claim 1 wherein said power tool is a drill.

12. A battery operated power tool comprising:

a housing defining a cavity, said housing including a pair of mating members each formed from a metallic material;

a motor received in said housing cavity;

an activation member extending from said housing, said activation member coupled with said motor;

an output member coupled with said motor, said output member adapted to drive a tool;

a member for electrically insulating or shielding said metal housing;

a battery coupled with said housing, said battery electrically coupled with said activation member for energizing and deenergizing said tool.

13. The battery operated power tool according to claim 12 further comprising a battery level indicator electrically coupled with said battery and mounted with said housing.

14. The power tool according to claim 12 further comprising a level indicator coupled with said housing.

15. The power tool according to claim 12 further comprising a gripping member coupled with said housing.

16. The power tool according to claim 12 wherein said housing pair include a handle portion.

17. The power tool according to claim 12 wherein said activation member includes a switch electrically coupled with said battery power source and said motor.

18. The power tool according to claim 17, said member for electrically insulating or shielding further comprising:

a polymeric housing surrounding said switch and positioned in said metal housing.

19. The power tool according to claim 18 wherein said polymeric housing being transparent.

20. The power tool according to claim 12 wherein a barrier plate being positioned between said battery and an inner cavity of said metal housing.

21. The power tool according to claim 12 wherein said output includes a transmission for transmitting power from the motor.

22. The power tool according to claim 21 wherein said transmission includes a polymeric housing, a first pinion gear, a first set of planetary gears, a first gear carrier and an insulating member between said first gear carrier and said first pinion gear for providing insulation against a possible failure route.

23. A cordless power drill comprising:

a metal housing;

a motor positioned inside said housing;

an output coupled with said motor;

a chuck coupled with said output for receiving a tool;

an activation member coupled with said motor;

a member for electrically insulating or shielding said metal housing; and a battery coupled with said activation member.

24. The cordless drill according to claim 23 wherein said activation member includes a switch electrically coupled with said battery power source and said motor.

25. The power tool according to claim 24, said member for electrically insulating or shielding further comprising:

a polymeric housing surrounding said switch and positioned in said metal housing.

26. The power tool according to claim 23 further comprising:

a polymeric subbousing in said metal housing, said polymeric subhousing shielding said activation member and motor from said metal housing.

27. The power tool according to claim 26 wherein said polymeric subhousing includes a first subhousing shielding said activation member and a second subhousing shielding said motor.

28. The power tool according to claim 23 wherein a barrier plate being positioned between said battery and an inner cavity of said metal housing.

29. The power tool according to claim 28 wherein said barrier plate being a polymeric material.

30. The power tool according to claim 23 wherein said output includes a transmission for transmitting power from the motor.

31. The power tool according to claim 30 wherein said transmission includes a polymeric housing, a first pinion gear, a first set of planetary gears, a first gear carrier and an insulating member between said first gear carrier and said first pinion gear for providing insulation against a possible failure route.

32. The power tool according to claim 23 wherein said battery power source includes a polymeric housing coupled with said metal housing.

33. A power tool comprising:

a metal housing;

a motor positioned inside said housing;

an output coupled with said motor, said output adapted to drive a tool;

an activation member coupled with said motor;

a battery powered source, said activation member electrically coupled with said battery power source for energizing and deenergizing said motor; and a barrier plate positioned between said battery and said metal housing.

* * * * *